United States Patent [19]

Dameron

[11] Patent Number: 4,797,953

[45] Date of Patent: Jan. 17, 1989

[54] NURSING SHAWL

[76] Inventor: Rodger S. Dameron, 2408 Maxwell, Midland, Tex. 79705

[21] Appl. No.: 78,411

[22] Filed: Jul. 27, 1987

[51] Int. Cl.[4] ..... A41D 1/20

[52] U.S. Cl. ..... 2/104; 2/102; 2/91

[58] Field of Search ..... 2/104, 102, 103, 48, 2/91

[56] References Cited

U.S. PATENT DOCUMENTS

| | | | |
|---|---|---|---|
| 1,879,341 | 9/1932 | Lapham | 2/102 |
| 2,303,383 | 12/1942 | Norton | 2/102 |
| 2,417,888 | 3/1947 | Schuster | 2/104 |
| 2,870,448 | 1/1959 | Rosenthal | 2/102 X |
| 3,611,439 | 10/1971 | Meyers | 2/74 |
| 4,106,122 | 8/1978 | Dodd | 2/104 |
| 4,208,743 | 6/1980 | Whitcraft | 2/104 |
| 4,446,572 | 5/1984 | Lindquist | 2/104 |
| 4,458,365 | 7/1984 | Wood | 2/104 |
| 4,468,816 | 9/1984 | Kaufer | 2/104 |
| 4,567,611 | 2/1986 | Kendrick | 2/104 |
| 4,601,068 | 7/1986 | Frechette | 2/104 |
| 4,631,754 | 12/1986 | Ryan | 2/104 |

OTHER PUBLICATIONS

The Nursing Bibb Advertising Brochure (date unknown).

Mother & Child Apparel & Gear Brochure, 1985.

Mother Nurture News & Views, 1986, issue 11.

Nursing Capelet Brochure (date unknown).

*Primary Examiner*—Louis K. Rimrodt

*Assistant Examiner*—Judith L. Olds

*Attorney, Agent, or Firm*—Marcus L. Bates

[57] ABSTRACT

A nursing shawl for use by mothers who nurse their infant. The shawl comprises two opposed panels joined together at the adjacent top corners by a neck band to provide a unitary shawl which can easily be placed about the mother and infant while the mother is seated. The panels drape over the shoulders and hang in front to conceal the nursing infant and the entire front of the mother from the neck to the waist. The confronting edges of the panels are fastened together by hook and loop fasteners. The shawl enables the mother and infant to view each other while the infant is nursing, and preserves their privacy.

9 Claims, 2 Drawing Sheets

FIG. 1
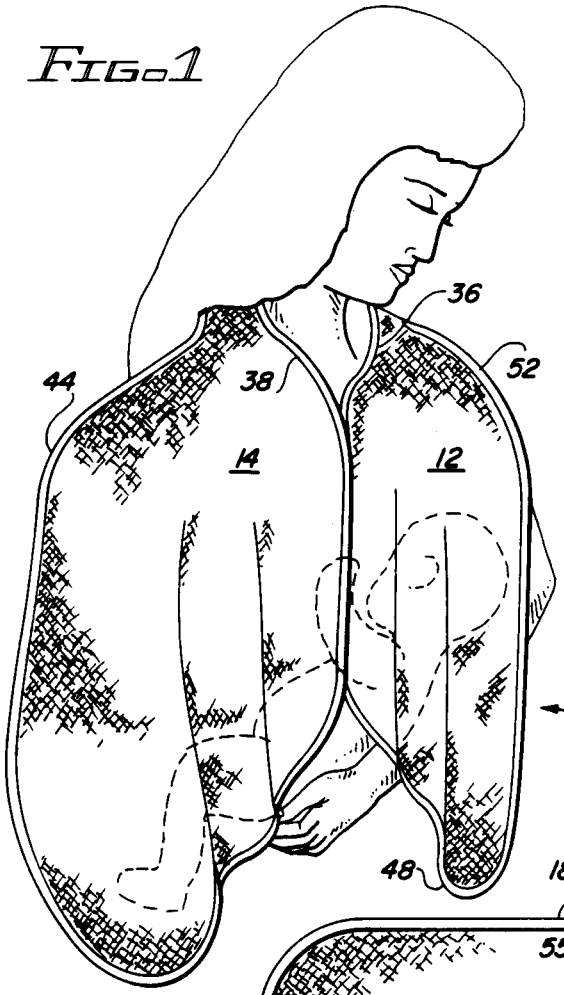
FIG. 2
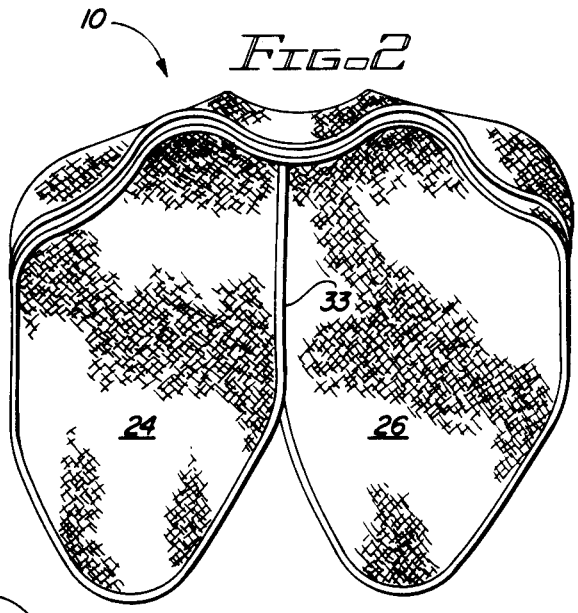
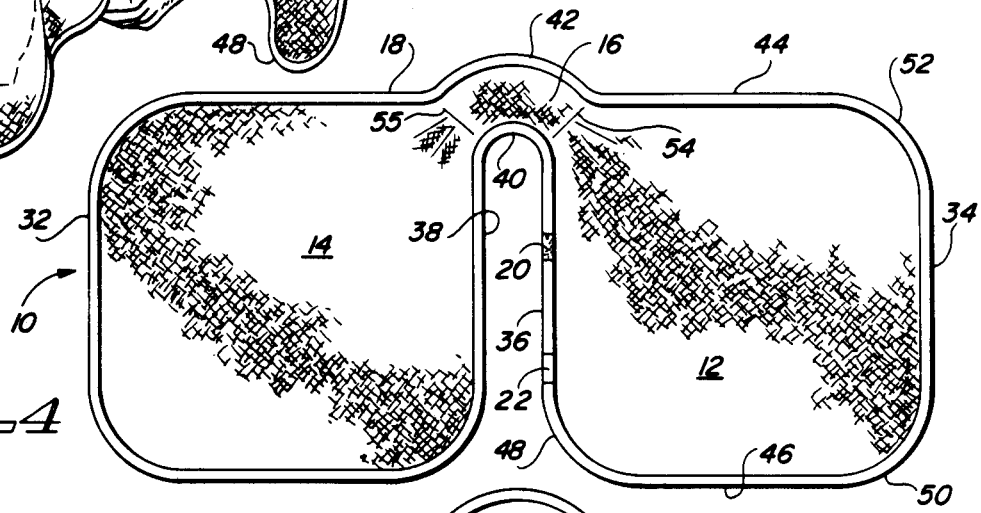
FIG. 4
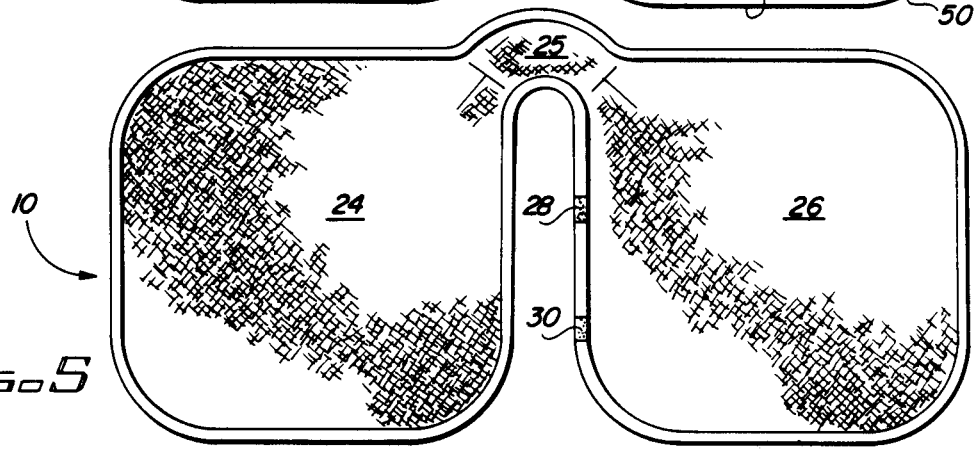
FIG. 5

FIG. 3
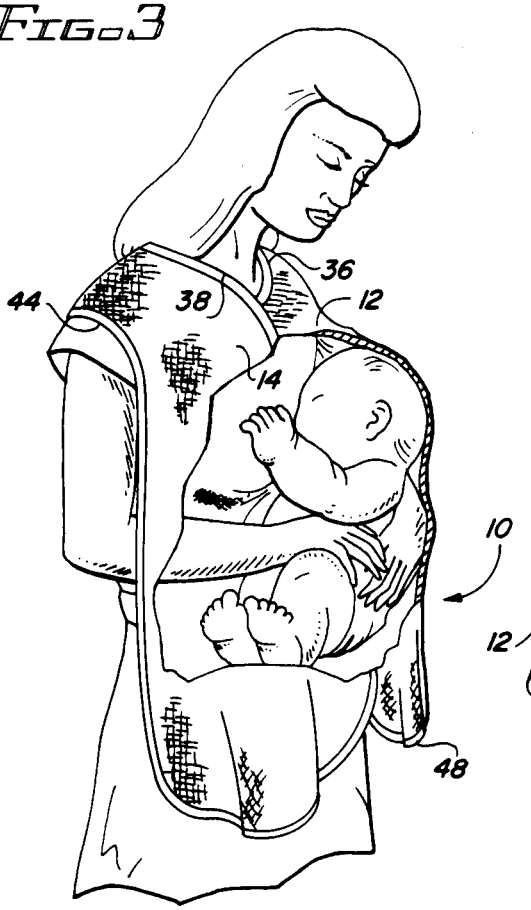
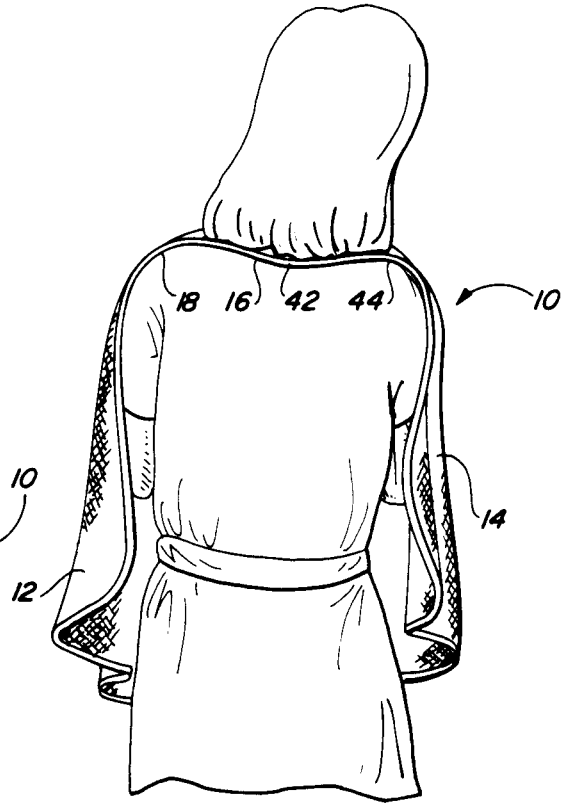
FIG. 8
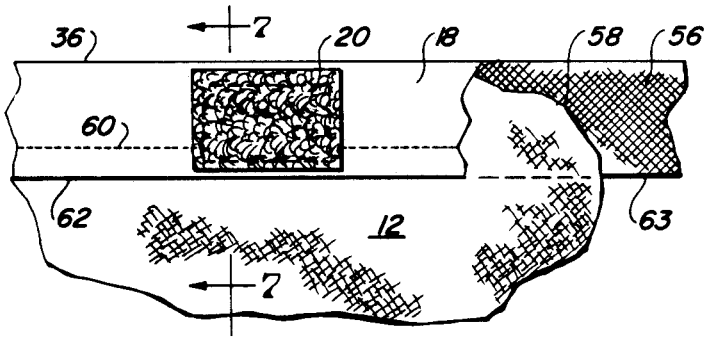
FIG. 6
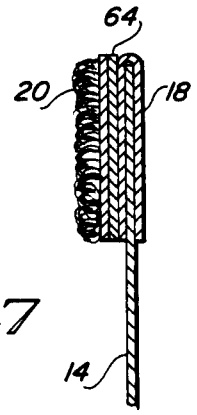
FIG. 7

NURSING SHAWL

BACKGROUND OF THE INVENTION

Mothers who breast feed their infants need to preserve their privacy and consequently, when the mother and baby are in a public location and it becomes necessary to feed the infant, there is always a problem of concealing the nursing infant from the eyes of curious strangers. Furthermore, the sight of a nursing infant at its mother's breast is considered by many to be beautiful and has been the subject of many paintings, poems, and the like. However, it is desirable to afford some degree of seclusion to the mother and infant, while at the same time providing a means by which the domestic scene is not forced or imposed on the immediate public.

Others have proposed various garments by which the mother's breast and nursing infant are obscured, as evidence by the U.S. Patents to Dodd U.S. Pat. No 4,106,122; Kaufer U.S. Pat No. 4,468,816; and Kendrick U.S. Pat. No. 4,567,611. These garments have the drawback of being difficult to dress in public, or alternatively, the garments must be worn all the time.

For example, while riding an airline there is very little maneuvering room and if an infant is to be nursed, it must be done while seated in the aircraft cabin because there simply is no other convenient place of privacy available to the mother and infant.

It would be desirable to have made available a nursing shawl which can be conveniently placed about the front of the mother and positioned to cover the nursing infant, thereby concealing or obscuring the nursing infant and preserving the privacy of the two. It would be desirable that the mother and baby be able to see one another in close proximity, but that their details are distorted from a distance, thereby providing observation by the mother and baby of each other, and preserving the privacy of the two, while at the same time others have the feeling that their privacy has not been intruded upon.

A nursing shawl which achieves the above desirable attributes is the subject of the present invention.

SUMMARY OF THE INVENTION

A nursing shawl for obscuring a nursing infant at its mother's breast. The shawl is of a configuration to enable it to be received or fitted to the mother while the mother is seated holding the infant. The shawl includes a left panel spaced from an opposed similar right panel, with the panels being joined together by a neck band at the upper center of the shawl. The neck band is received across the back of the nursing mother, with the right panel extending from the right shoulder, down over the right breast; and, the left panel extending from the left shoulder down over the left breast. This attire completely covers the front of the mother from the neck to the waist when the right and left panels are fastened together in slight overlapping relationship.

The nursing shawl therefore comprises a unitary piece of fabric-like material made of a plurality of individual sewed together panels. The shawl has a continuous perimeter that defines the boundary thereof. The neck panel is a segment of an annulus, having inner and outer curved edges radially spaced from one another that terminate in opposed sides that are joined at an oblique angle to the adjacent corners of right and left panels.

The right and left panels are two pieces of equal proportion and equivalent shape having upper and lower parallel edges, opposed vertical sides, and adjacent vertical sides, with the upper adjacent corners being joined to the sides of the neck panel.

The neck band and the upper marginal end of the right and left panels lay across the back with the right and left panels extending down the front. The adjacent edges of the right and left panels are joined together so that the front is covered from one side to the other, and from the neck to the waist.

The panels preferably are made of lace or gauze-like material which enables the mother and infant to view one another and which at the same time obscures the nursing infant from the eyes of the more distant public.

A primary object of the present invention is the provision of a nursing shawl which hangs in front of a mother and covers a nursing infant so that the mother and infant enjoy privacy while nursing in public places.

Another object of this invention is the provision of a nursing shawl which enables a mother to tastefully nurse an infant in public by obscuring the front of the mother from the public.

Still another and further object of the present invention is the provision of a nursing shawl which can be worn externally of other clothing, and is easily installed while seated in public.

An additional object of this invention is the provision of a nursing shawl which can be worn as a supplemental outermost garment while seated so that a mother and infant can view each other at close proximity, but the details thereof are distorted from a distance, thereby preserving the privacy of the two.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

BRIEF DESCRIPTION OF THE DRAWINGS

FIG. 1 is a front, perspective view of a nursing shawl made in accordance with the present invention and illustrated in the operative configuration;

FIG. 2 is a rear view of the nursing shawl disclosed in FIG. 1;

FIG. 3 is a side view of the nursing shawl illustrated in FIGS. 1 and 2;

FIG. 4 is a top, plan view of the nursing shawl disclosed in the foregoing figures;

FIG. 5 is a bottom, plan view of the shawl of FIG. 4;

FIG. 6 is an enlarged, fragmentary, part cross-sectional view of part of the nursing shawl disclosed in the foregoing figures;

FIG. 7 is a cross-sectional view taken along line 7—7 of FIG. 6; and, FIG. 8 is a rear view of the nursing shawl disclosed in the foregoing figures.

DETAILED DESCRIPTION OF THE PREFERRED EMBODIMENT

The figures of the drawings disclose a nursing shawl 10 made in accordance with the present invention. In FIGS. 1, 3 and 8, the shawl is shown in its operative configuration, that is, being worn by a mother while nursing an infant. It is to be noted that the shawl extends from the mother's neck to her waist, and from one to the other side thereby obscuring the baby and the front of the mother.

The nursing shawl 10 of this invention has a left panel 12 opposed to a right panel 14. As seen in FIG. 2, numerals 24 and 26, respectively, indicate the back side, or rear surface, of the panels 12 and 14. As seen in FIGS. 4 and 5, the shawl, when laid on a flat surface, has the right and left panels spaced from one another, and joined together by a neck band 16. The neck band 16 is a segment of an annulus and forms a yoke respective to the contiguous panels. Accordingly, it can be seen that the nursing shawl of this invention comprises a plurality of panels 12, 14, and 16 joined together into a unitary panel of a unique geometrical configuration defined by the circumferentially extending edge portion 18.

As seen in FIG. 4, hook and loop fastener material 20, 22 is strategically positioned on one side of panel 12. As seen in FIG. 5, the rear 25 of the neck band 16 is received against the neck. Hook and loop fastener material 28, 30 is placed on rear side 26 of the opposing panel 14 so that the two panels, 12 and 14, can be conveniently fastened together in a releasable manner in order to cover the entire front of the nursing mother from the neck to the waist and from one side to the other.

The opposed panels 12 and 14 have outermost edges 32, 34 that hang down by the sides of the mother in a draped manner. In FIGS. 2 and 4, numeral 33 (FIG. 2) indicates the overlapping relationship of the near marginal edges 36, 38 (FIG. 4) of the panels 12 and 14.

The before mentioned neck band 16, as best seen in FIG. 4, is defined by two concentric circles 40, 42 having opposed oblique sides 54, 55 joined to the upper adjacent corners of panels 12 and 14. The oblique sides 54, 55 lie at an included angle of 90° respective to one another. The centers of the circles 40, 42 can be a common point lying somewhere between adjacent edges 36, 38, as for example a radius of 6" and 8".

In FIG. 4, numerals 44 and 46 indicate the top and bottom of the panel 12. Numerals 48, 50, and 52 indicate the curved or rounded corners of panel 12.

In FIG. 6, numeral 56 indicates the inner facing of the bias tape that forms the circumferentially extending continuous edge portion 18. Numeral 58 indicates the terminal edge portion of the lace or gauze-like fabric that makes up panel 12 and which is encapsulated by the biased tape. Stitching is applied at 60 to secure the bias tape to the marginal edge portion of the fabric. Numerals 62 and 63 indicate the opposed edges of the bias tape located on the opposed sides of the panel 12. As seen from the cross-sectional view in FIG. 7, numeral 64 is any suitable adhesive material by which the hook and loop fastener material 20 is attached to the binder or bias tape 18 which encapsulates the opposed marginal edges of fabric 14. Stitching can instead be employed.

In FIG. 8, the nursing shawl 10 is shown in its operative configuration from the back or rear view. Panels 12, 14, and 16 encased by continuous edging 18 is shown draped around the back of the mother's neck with outer curved edge 42 of the neck band 16 resting across the shoulders farthest from the mother's neck. Panels 12 and 14, which hang down from the shoulders by the sides of the mother in a draped manner, indicate that the nursing shawl 10 extends from the mother's neck to her waist and from one side to the other.

The opposed panels of the nursing shawl are in the form of polygons joined at the upper adjacent corners to a curved neck band. In the preferred embodiment of the invention, the polygons are parallograms having opposed parallel sides, with three of the corners thereof being rounded into a pleasing curve. The parallograms may be squares, as shown, or rectangles, as may be desired. The shawl, which is of unitary construction, can be made of component parts, as illustrated herein, or alternatively can be made of one large piece of material having the marginal edge suitably folded and stitched to provide a hem.

The nursing shawl of the present invention provides a convenient means by which mothers who breast feed their infants can obtain privacy from nearby persons. As seen in the figures of the drawings, the shawl comprises two opposed panels attached together by a neck band. The two panels hang in front of the mother, draping over her shoulders and covering the infant. Hook and loop fastener material, such as Velcro (TM) fastener material, for example, secures the near edges of the two panels in a releasable manner. With the panels attached, the garment is secure, comfortable, and conceals or obscures the nursing infant from persons observing from a distance.

The two panels preferably are made of lace or gauze-like material of a density which can enable the mother and the baby to see one another at close range, but distorts the details of the nursing infant when viewed from a distance. This provides observation by mother and infant of each other and preserves the privacy of the two, as well as giving other people in the immediate vicinity a feeling that they have not been imposed upon.

The shawl is easily put on by the seated mother by holding the upper adjacent corners of the right and left panels and placing the neck band about the neck, while allowing the two panels 12 and 14 to drape over the front. The infant is easily snuggled up under the shawl while the free hand fastens the two panels together. Later on the infant can easily be changed to the other breast using both hands to manipulate the infant in a manner well known to mothers.

Where the material of construction is heavier or closer woven than lace, the shawl can be used for protection of one's suit when it becomes necessary to "burp" the infant.

I claim:

1. A nursing shawl of unitary design that can be worn by a mother nursing an infant, said shawl is symmetrical about a centerline, said shawl comprising a left panel spaced from a right panel, and a neck band, said right panel and said left panel are of general rectangular configuration and are joined together by said neck band at the upper center of the shawl;

the right and left panels have outer opposed edges, inner confronting edges, and upper edges spaced from lower edges; said neck band being a segment of an annulus having a circumference determined by spaced sides; the upper adjacent corners of said panels are cut obliquely and attached to said spaced sides of the neck band; said neck band is defined by concentric circles having oblique sides joined to the upper adjacent corners of said left and right panels; whereby:

said neck band is received across the back of a nursing mother, with the right panel extending from the right shoulder down over the right breast; and, with the left panel extending from the left shoulder down over the left breast with the panels jointly covering the entire front of the mother from the neck to the waist, and from one side to the other while the outer opposed edges hang down by the sides of the mother in a draped manner.

2. The nursing shawl recited in claim 1 wherein said panels are made of a lace-like material so that the mother sees the baby through the panels, the baby sees the mother, and the baby is obscured from others; and, the neck piece only is to the rear of the mother.

3. The shawl of claim 2 wherein there is a continuous uninterrupted edge portion that defines the continuous unitary garment.

4. The shawl recited in claim 3 wherein hook and loop fasteners are applied to the confronting edges of said side panels so that the panels can be releasably fastened together.

5. A nursing shawl of unitary design worn by a mother nursing an infant, said shawl is symmetrical about a centerline, said shawl comprising a left panel spaced from a right panel, and a neck band; said right panel and said left panel are of general rectangular configuration and are joined together by said neck band at the upper center of the shawl;

the right and left panels have outer opposed edges, inner confronting edges, and upper edges spaced from lower edges; said neck band being a segment of an annulus having a circumference determined by spaced sides; the upper adjacent corners of said panels are cut obliquely and attached to said spaced sides of the neck band;

said neck band forms a yoke and is received across the back of a nursing mother, with the right panel extending from the rights shoulder down over the right breast; and, with the left panel extending from the left shoulder down over the left breast so that the panels jointly cover the entire front of the mother from the neck to the waist, and from one side to the other while the other opposed edges hang down by the sides of a mother in a draped manner.

6. The nursing shawl recited in claim 5 wherein said panels are made of lace-like material so that the mother sees the baby, the baby sees the mother, and the baby is obscured from others; and, the neck piece only is to the rear of the mother.

7. The shawl of claim 6 wherein there is a continuous uninterrupted edge portion that defines the continuous unitary garment.

8. The shawl recited in claim 7 wherein hook and loop fasteners are applied to the confronting edges of said side panels so that the panels can be releasably fastened together.

9. A nursing shawl of unitary design adapted to be worn by a mother nursing an infant, said shawl is symmetrical about a centerline, said shawl comprising only a left panel, a right panel, and a neck band; said left panel is spaced from said right panel by said neck band; said right panel and said left panel are of general rectangular configuration and are joined together by said neck band only at the upper center of the shawl;

said panels are made of lace-like material so that the mother can see the baby, the baby can see the mother, while the baby is obscured from others; and, the neck piece only is to the rear of the mother;

said right and left panels have outer opposed edges, inner confronting edges, and upper edges spaced from lower edges; said neck band being a segment of an annulus having a circumference determined by spaced sides which lie perpendicular respective to one another; the upper adjacent corners of said panels are cut obliquely and attached to said spaced sides of the neck band;

said neck band is received only across the upper back of a nursing mother, with the right panel extending from the right shoulder down over the right breast; and, with the left panel extending from the left shoulder down over the left breast so that the panels jointly cover the entire front of the mother from the neck to the waist, and from one side to the other while the outer opposed edges hang down by the sides of a mother in a draped manner;

wherein there is a continuous uninterrupted edge portion that defines the continuous unitary garment; and, hook and loop fasteners are applied to the confronting edges of said side panels so that the panels can be releasably fastened together.

* * * * *